United States Patent [19]

Brownell et al.

[11] 3,959,172

[45] May 25, 1976

[54] PROCESS FOR ENCAPSULATING RADIONUCLIDES

[75] Inventors: Lloyd E. Brownell; Raymond E. Isaacson, both of Richland, Wash.

[73] Assignee: The United States of America as represented by the United States Energy Research and Development Administration, Washington, D.C.

[22] Filed: Sept. 26, 1973

[21] Appl. No.: 401,090

[52] U.S. Cl. ..... 252/301.1 W; 61/.5

[51] Int. Cl.[2] ..... G21F 9/24

[58] Field of Search ..... 252/301.1 R, 301.1 S, 252/301.1 W; 423/328, 329, 326; 61/.5

[56] References Cited

UNITED STATES PATENTS

| | | | |
|---|---|---|---|
| 3,252,757 | 5/1966 | Granquist | 423/328 |
| 3,340,202 | 9/1967 | Olombel | 252/301.1 |

OTHER PUBLICATIONS

"GE Gel May Hold Radioactive Waste" Chemical & Engineering News Vol. 36, Jan. 1958 p. 42.

"A Hydrothermally Synthesized Iron Analog of Pollucite – Its Structure Significance" Am. Minerologist 48 p. 100–109 (1963).

*Primary Examiner*—Benjamin R. Padgett
*Assistant Examiner*—Deborah L. Kyle
*Attorney, Agent, or Firm*—John A. Horan; Robert M. Poteat

[57] ABSTRACT

Radionuclides are immobilized in virtually an insoluble form by reacting at a temperature of at least 90°C as an aqueous alkaline mixture having a solution pH of at least 10, a source of silicon, the radionuclide waste and a metal cation, the molar ratio of silicon to said metal cation being on the order of unity to produce a gel from which complex metalosilicates crystallize to entrap the radionuclides within the resultant condensed crystal lattice. The product is a silicious stone-like material which is virtually insoluble and non-leachable in alkaline or neutral environment. One embodiment provides for the formation of the complex metalo-silicates, such as synthetic pollucite, by gel formation with subsequent calcination to the solid product; another embodiment utilizes a hydrothermal process, either above ground or deep within basalt caverns, at greater than atmospheric pressures and a temperature between 90° – 500°C to form complex metalo-silicates, such as strontium aluminosilicate. Finally, another embodiment provides for the formation of complex metalo-silicates, such as synthetic pollucite, by slurrying an alkaline mixture of bentonite or kaolinite with a source of silicon and the radionuclide waste in salt form.

In each of the embodiments a mobile system is achieved whereby the metalo-silicate constituents reorient into a condensed crystal lattice forming a cage structure with the condensed metalo-silicate lattice which completely surrounds the radionuclide and traps the radionuclide therein; thus rendering the radionuclide virtually insoluble.

2 Claims, No Drawings

PROCESS FOR ENCAPSULATING RADIONUCLIDES

BACKGROUND OF THE INVENTION

The invention described herein was made in the course of, or under, a contract with the United States Atomic Energy Commission.

This application is a continuation-in-part of application Ser. No. 265,041 filed June 21, 1972, now abandoned. The present invention relates to a method of immobilizing radionuclide wastes in a stable, essentially non-leachable and non-dispersible form. More specifically, it relates to a method of immobilizing radionuclide waste in highly insoluble complex metalo-silicates.

A problem facing the nuclear industry which has received much attention is how to dispose of radionuclide wastes so that they will never contaminate the biosphere with radioactivity. Since all containers, no matter how complex, have a finite life which is short with respect to the halflife of plutonium (24,400 years), containerization of radionuclide wastes cannot be relied on alone for ultimate disposal of radionuclide waste. Acid environment should, of course, be avoided as a storage media where possible. Heretofore many attempts, all having differing drawbacks, have been made for immobilizing the radionuclide wastes, viz. $^{137}Cs$, $^{90}Sr$, $^{239}Pu$, $^{241}Am$, etc. Such attempts have included incorporation of radionuclide waste in phosphate glass, asphalt, concrete and in ceramic material of many kinds and storing the encapsulated material out of the biosphere in a salt or bedrock cavern. Even through the material formed in some of the suggested processes is quite insoluble, much is left desired in providing an effective bulk disposal process for immobilizing nuclear wastes.

With regard to waste disposal by encapsulation in mineral form which is virtually insoluble and placement in a similar mineral environment deep underground, one would approach an almost ideal mode of disposing of the highly dangerous radionuclide waste as a by-product by the nuclear industry.

Accordingly, it is an object of this invention to provide a method for the immobilization of radionuclides in virtually an insoluble non-leachable form.

Another object is to provide an economic and efficient method for immobilizing radionuclides, such as $^{137}Cs$, $^{90}Sr$.

SUMMARY OF THE INVENTION

The present invention, broadly, provides for the immobilization of radionuclide wastes by reacting at a temperature of at least 90°C as an aqueous alkaline mixture having a solution pH of 10 to 12, (1) a source of silicon, (2) the radionuclide waste, and (3) a metal cation, the molar ratio of silicon to said metal cation being on the order of unity, to produce a gel from which complex metalo-silicates crystallize to entrap the radionuclides within the resultant condensed crystal lattice. By the term "metalo-silicates" as used herein it is intended to refer to metal oxides such as "alumino" - that share their oxygen with silicon so as to permit the tetrahedral configuration of the stable $SiO_4$ lattice. It has been found that an ionic, as well as a mechanical, cage could be formed in a condensed lattice of complex metalo-silicates under mobile conditions (i.e., produced by the hereinbefore given critical pH and temperature parameters) which entraps the radionuclides, such as $^{137}Cs$, $^{90}Sr$, etc.

In one embodiment cesium ions were immobilized in synthetic pollucite ($Cs_2O$-$Al_2O_3$ — n $SiO_4$) with *n* equal to 4 and without any water of hydration by formation of a cesium aluminosilicate gel at atmospheric pressure, a solution of about 10 and a temperature between 20° and 100°C followed by holding at 90°–100°C and slowly heating to 600°C to evaporate the water of hydration and consolidate the cesium ion in its aluminosilicate cage. In another embodiment strontium ions were immobilized in solid microcrystalline strontium aluminosilicate ($SrO$ — $Al_2O_3$ — $2SiO_2$), known as orthorhombic strontium feldspar, an analog of celsian a barium feldspar, by hydrothermal formation of a strontium aluminosilicate gel at a temperature between 90° and 500°C and at greater than atmospheric pressure with a solution pH of at least 10. In still another embodiment cesium ions as an oxide or hydroxide slurry are immobilized in cesium aluminosilicate by reacting with bentonite at 90° to 100°C and solution pH of 12.5.

In each of these embodiments a complex metalo-silicate product is formed under aqueous conditions at solution pH of at least 10 whereby the metalo-silicate constituent becomes mobile, reorienting itself to form an ionic, as well as a mechanical, cage around the radionuclide and traps the radionuclide therein. The resulting product is a silicious, stone-like material which is highly stable and is essentially non-leachable (i.e., is more than a thousand times less soluble than, for example, phosphate glasses) and thus provides an excellent method for disposing of radionuclide wastes. The present invention provides wide latitude in process parameters and can be, for example, conducted above ground or in situ in caverns deep below ground in equilibrated silicate environments.

DESCRIPTION OF THE PREFERRED EMBODIMENTS GEL PROCESS

In carrying out the process of this invention complex metalo-silicates are formed in an aqueous system under hereinbefore defined critical process conditions such that radionuclides are caged within the metalo-silicate structure; thus entrapping the radionuclide therein.

It should be understood here the present invention may be practiced with any of the metals which form complex silicates, such as aluminum, iron, zinc, manganese, etc. Moreover, it will be appreciated that the particular complex metalo-silicate product will be analogous to widely different mineral forms, depending upon the particular radionuclide or mixtures thereof to be immobilized. Where, for example, the radionuclide is radioactive cesium, the complex metalo-silicate product is synthetic pollucite; where radioactive strontium, the product is sythetic strontium feldspar, an analog of celsian; where plutonium, the product is synthetic plutonium silicate, an analog of zircon. For waste mixtures of oxides of cesium strontium, plutonium and other radionuclides a mixed system of silicates and complex silicates will be synthesized hydrothermally as in the natural hydrothermal synthesis found in pegatites and some feldspar. Pollucite and plutonium silicate crystals may grow simultaneously but in separate clusters of crystals.

The present invention is carried out in its simplest form by gel formation. The gel process will be hereinafter described with particular reference to the immobilization of radioactive cesium in synthetic pollucite ($CsO_2 - Al_2O_3 - 4\ SiO_2$). Aluminosilicate gels may be prepared by mixing alkaline solutions of silicates, aluminates and hydroxides in a limited region of mixture compositions; when carried out in this manner gel formation proceeds by polymerization and the resulting gel has a high viscosity which immobilizes the radionuclide almost immediately. While any of the alkali silicate solutions, such as sodium silicate, may be used as a source of silicon and alkalinity, the solution pH must be at least as great as 10 to supply silicon in solution in sufficient concentration to form an aluminosilicate gel. Until the gel is formed, the cesium ions are free to move about in solution. After the formation of the gel cesium ions act as nucleation centers for crystal formation. The first step in the process involves the clustering of aluminosilicate tetrahedrons in the gel about the $Cs^+$ ions to balance the charge when an $Al^{+3}$ is substituted for a $Si^{+4}$ in a tetrahedron of the gel. As the precursors of the crystal lattices from in the gel, 12 oxygen atoms in the gel associate with individual $Cs^+$ ions. With an adequate temperature (90°C or more) and time, the aluminosilicate groups of the gel coalesce into a crystalline lattice constituting the pollucite cage. As the gel coalesces, water is forced from the gel structure converting it to a rigid three-dimensional structure. This describes the molecular encapsulation of radionuclide cations inside stable aluminosilicate structures in which pH is an important factor to supply silicon in solution and to speed the reaction. Similarly, many of the alkaline aluminate solutions are satisfactory as a source of the alumino-group but it is preferred that the alkaline aluminate solution comprise a sodium aluminate solution because of solubility. As an alternative, the alumino-group may be prepared for aluminum hydroxide; cesium is added as the hydroxide in the preferred method.

With bentonite as a starting material the high pH of 10 or more has an added function and is required to bring about chemical attack of the existing aluminosilicate structure of the bentonite. This permits the formation of an aluminosilicate gel which is a prerequisite for the production of crystalline pollucite. Both aluminum and silicon are sufficiently soluble only at high pH for gel formation. Below a pH 8.0 only uncharged silicic acid $Si(OH)_4$ contributes significantly to the silicon in solution equivalent to about 50 ppm silicon. At pH of 10 or more, several silicate species contribute to the significantly greater total soluble silicon available at the higher alkalinity. The Ph affects the stability of the gel and the composition of the ionic species in solution and thus is critical prior to the beginning of crystallization. During crystallization of pollucite, cesium oxide is locked into an aluminosilicate lattice decreasing the alkalinity of the solution and causing the solution pH to drop. The alkaline solutions of cesium hydroxide, sodium slicates and sodium aluminates are first mixed at atmospheric pressure and 20°C. The mixture is heated to 90° to 100° and held at this temperature for a period of about two weeks with the formation of a precipitate of crystals. The crystals of pollucite may be washed to remove sodium compounds and the surplus water is removed by evaporation and the resulting solids heated slowly to dryness and a temperature of about 800°C. It has been found that the typical pollucite lattice is completely formed at 90°C in this gel process but the presence of sodium ions and water molecules may result in some distorted lattices and some hydrates cages. Heating to a high temperature of 600° to 800°C not only drives off the water from any hydration but permits a consolidation of the cesium ion in its aluminosilicate cage. This additional heating is not critical to formation of pollucite since it is completely formed below 100°C but is preferred. The time required for gel formation at 90°C depends strongly on the composition of the mixture. It is minimal for mixtures in which the Si/Al molar ratio is unity and increases as the molar ratio changes from unity. If the molar ratio is very large, e.g., 9.0 or more, or very small, e.g., 0.3 or less, or if the solution is highly alkaline (pH>12) gels are not formed with some systems, and the silicates remain in solution.

It has been found that by gel formation and a subsequent evaporation and calcination operation the cesium is locked in the lattice structure of the aluminosilicate structure. It is believed, without wishing to be rigidly held to any particular mechanism of the invention, that the cesium ions are surrounded and trapped by 12 oxygen atoms of the aluminosilicate lattice which reorientents itself under the aforementioned mobile conditions. More specifically, it is postulated that in a molecule of synthetic pollucite produced by this process, one cesium is arrayed with one aluminum atom, two silicon atoms and six oxygen atoms, which are in turn associated with the adjacent molecules in a three-dimensional system. The three oxygen atoms closest to the cesium atom form part of the cage of twelve oxygen atoms that encapsulate cesium in the three-dimensional lattice. X-ray studies of the formed synthetic pollucite show that the centers of six of the oxygen atoms are 3.40 Angstroms from the center of the cesium atom. The other six oxygen atoms of the cage are at a distance of 3.57 Angstroms. Thus the cesium atom is surrounded by twelve oxygen atoms spaced almost equidistantly in a spherical cage around the cesium atom. Each oxygen atom has a diameter of 2.64 Angstroms which leaves insufficient clearance between the oxygen atoms for passage of a 3.38 Angstrom diameter cesium ion.

In this array the cesium is believed to be locked in as a cesium clathrate and cannot be exhanged. The solubility of the cesium has thus, by this gel formation technique with subsequent calcination, been reduced to that of the cesium aluminosilicate lattice which has been found to be virtually insoluble in neutral or alkaline water. It should be emphasized here that the finding that cesium silicate which has heretofore been thought to normally be quite soluble and non-volatile to temperatures of 1450°C or more in a reducing atmosphere by the formation of this cesium clathrate is quite surprising and forms the basis for control of the volatility of radioactive cesium atoms in this waste encapsulation process.

Regarding gel formation, the aluminosilicate gels are typically colloidal structures and gel skeletons are formed by joining contacting particles of colloidal size. The alkali cations, such as $Na^+$, $Cs^+$, $Sr^{++}$, act as orientation centers for the aluminosilicate polymers. Layers of water molecules exist around the ions and each ion with its associated water molecules from primary hydration undergoes Brownian motion as a whole. The number of water molecules involved in primary hydration of ions is related to the coordination numbers. For ions with radii of 1.3 to 2.0 Angstroms the most stable grouping occurs with a coordination number of 6 and for smaller ions, e.g., radii of >1.3 Angstroms, with a coordination number of 4.

The gel is formed by interaction of a sodium aluminate solution (which contains the radionuclides either in solution or as suspended hydroxides) with silica gel, sodium silicate or cesium silicate solutions or mixtures thereof. The aluminum silicate gel which forms will have a high viscosity if high concentrations of the solutes are used. The high viscosity immobilizes the radionuclides almost immediately. Many alternate methods of forming the gel and alternate compositions exist. Sodium or cesium hydroxides or mixtures thereof may be used as a starting point with sodium or cesium silicates. Some sodium hydroxide or sodium silicate should be used to aid dissolution before reaction as cesium hydroxide alone is too weak as a base. Aluminum hydroxide or iron hydroxide may be used to form the complex silicate gel upon reaction with soluble silicates.

Immobilization of cesium atoms will next be described specifically. Holding the gel at a temperature of 90°C or higher causes the tetrahedral units of alumina and silica to orient into octahedral groups around the cesium ion, forming the crystalline silicate pollucite. If the gel had been formed in the presence of sodium or potassium ions without cesium present, silicates of the zeolite family with vacancies in the lattices produced by water of hydration present during crystallization would result instead. These vacancies give zeolites their unusual characteristic of storing water of hydration, absorbed gases and ion exchange. In addition to Si and Al of the zeolite matrix, cations of Na, K, Li, Ca or Mg may be found in the "exchangeable" positions if these cations are present in the gel. The only radionuclide in the Group I metals is cesium. This cation by itself will not form a true zeolite with the aluminosilicate gel with the characteristic of storing water of hydration because of the larger ionic radius of Cs (1.65A) as compared to Na (0.98A), Li (0.78A), Ca (1.06A). Only with difficulty have Rb (1.49A) zeolites been prepared.

Cesium, however, forms complexes of both cesium aluminosilicate and cesium ferrosilicate. Both complexes are insoluble in alkaline or neutral solutions. The cesium aluminosilicate is the form that corresponds to the natural crystalline mineral, pollucite. In pollucite the lattice of the aluminosilicate forms a cage around the cesium ion which is tight enough to prevent exchange of the cesium ion by leaching, ion exhange or volatization. Thus, the complex silicate crystals synthesized from cesium silicate or cesium hydroxide solutions are specific for the permanent molecular encapsulation of cesium ions. The lattice of the aluminosilicate network in effect forms a cage that holds the cesium inside, as will be shown.

The positive charge of a Group I cation causes hydration of the ion. After the mixing of a solution of cesium silicate with a solution of sodium aluminate in an alkaline solution with caustic or sodium silicate so as to produce an aluminum silicate gel the silica and alumina groups collect around the $Cs^+$ ion crystallization centers. The joining of the alumina and silica through common oxygen atoms that are shared permits orientation in the tetrahedral configuration. This matrix can be considered as an inorganic polymer and the basis for the gel.

The aluminosilicate gel tends to form a more stable crystalline lattice with a lower thermodynamic potential than the gel. This is the process of crystallization and the rate increases with the temperature. In the case of cesium aluminosilicates the contraction of the aluminosilicate gel to a crystal lattice forces out the molecules of water from the hydrated cesium ion. The synthetic crystalline pollucite in which the cesium ion is the only Group I crystallizing center is an anhydrous silicate without water of hydration. Natural pollucite is contaminated with some sodium ions and to a lesser extent potassium ions that replace some of the cesium ions as crystallization centers. Sodium has an ionic radius of only 0.95A as compared to 1.69A for cesium. The smaller radius of the sodium ion allows room for molecules of water of hydration. As a result, natural pollucite has some water of hydration associated with the substitution of other cations for some of the cesium centers.

The stability of the cesium ions within the lattice cage of the aluminosilicates is extremely high. Even by exposing the aluminosilicate product produced herein to temperature up to 1450°C in a reducing atmosphere the ionic cage could not be broken with subsequent release of the trapped cesium. (Less than 7% cesium was lost on first heating to 1670°C with negligible additional cesium being lost on a second heating to 1900°C). This extremely high stability affords unique advantages to the waste encapsulation gel process.

HYDROTHERMAL PROCESS

In another embodiment of the invention radionuclides are immobilized as complex metalo-silicates in a hydrothermal process by the formation of a metalo-silicate gel, adding an aqueous solution of the radionuclide waste thereto while maintaining the temperature between 90° and 500°C under a pressure greater than atmospheric and at a solution pH of at least 10 for a period of time to promote hydrothermal growth of the crystals.

The crystal growth from a gel follows an induction period during which the cation of the radionuclide waste, i.e., cesium, strontium, etc., acts as a nucleus, attracting the metalo-silicate polymer rings and ejecting water of hydraction molecules from their positions around the cations. This results in a nucleus of a single crystalline lattice which becomes a site for the addition of other metalo-silicate lattices with caged cations causing growth of the crystals. Under these conditions the radionuclides are trapped in a cage formed in the complex metalo-silicate condensed crystal lattice and rendered virtually insoluble.

This process is typified by the immobilization of strontium ions in aluminosilicate ($SrO - Al_2O_3 - 2SiO_2$) which is in the form of the orthorhombic polymorph of strontium feldspar. It will be noted that a similar crystalline structure can be formed which is a hexagonal polymorph of strontium feldspar but the orthorhombic form is preferred to the hexagonal form because it is considered to be more stable, particularly at elevated temperatures. The orthorhombic strontium feldspar is assured by using molar ratios of $Al_2O_3/SiO_2$ within the range of 1:1 to 1:9 at a temperature of 300°C.

In general, the higher the value of $n$ (for $nSiO_2$) and the lower the temperature, the longer is the time required to produce crystals from gels. If $n>5$, gels can remain amorphous for more than three weeks at 200°C; with low values of n, e.g., $n=2$, crystallization at 200°C may be complete in about 24 hours.

As an alternative to the hereinbefore described hydrothermal process, which is conducted above ground, the present invention is quite amenable to immobilizing radionuclide wastes in situ in deep caverns below the earths' surface by hydrothermal conversion of metalo-silicate gels to crystalline complex metalo-silicates. According to this process strong hydrochloric acid (18°) is pumped into a deep well into a weathered basalt zone, which has a nominal composition of $SiO_2$-54%; FeO-15%; $Al_2O_3$-13%; $Na_2O$-3%; CaO-8%; and MgO-4% (by weight percent). The well may be provided with a casing to assure that the hydrochloric acid reaches the basalt zone. The acid will dissolve out some of the aluminum, iron and calcium from the basalt as chlorides, forming a large cavern and leaving silica that has low solubility in the acid solution. The acid, which is neutralized by the alkaline basalt, is followed with a water wash and then caustic is injected to raise the pH and to dissolve the silica that accumulates at the bottom of the cavern after the acid leach. This produces a solution of sodium silicate which also contains some of the soluble silicates $K_2O$ and $Na_2O$ derived from the basalt and raises pH to 10 or more.

Preferably water is pumped from four drilled wells at the corners of the cavern to control the distribution of the sodium silicate solution and to obtain a model of the flow pattern. Then a radionuclide waste, such as a stored salt cake, is slurried with water and pumped into the cavern. There the radionuclide cations react with the aluminosilicate gel and soluble sodium silicate to produce cesium aluminosilicate, cesium ferrosilicate, strontium aluminosilicate and thus encapsulating by cage formation the radionuclide cations in the complex mixed metalo-silicate lattice. Elevated temperatures of 90°C or more aids in crystallization by speeding passage through the induction period that occurs between gel formation and the initiation of crystallization.

Advantageously the present invention may be practiced with raw radionuclide waste, such as produced in the plutonium recovery plant at Hanford, Washington. In that recovery process great quantities of nitrate - containing radionuclide waste solution are produced and upon neutralization and solidification a salt cake is obtained consisting primarily of sodium nitrate (~45 wt%), sodium carbonate (~30 wt%) and caustic (~10 wt%), with minor amounts (<1 wt%) of other salts such as cesium and strontium which are highly radioactive and very dangerous. Other than sodium the principal cations in the salt cake waste solutions are iron, aluminum and calcium (total about 5 wt%) with about 10 wt% water of hydration. Thus, this waste provides both caustic and carbonate which seems to increase the alkalinity of the solution to a pH above 10 providing more soluble silicates and improves the rate of crystallization of the metalo-silicates and silicates of the radionuclide cations. Moreover, the waste is thermally hot which promotes crystallization of the formed complex metalo-silicates.

It should thus be apparent that the basalt and the waste after conversion to complex metalo-silicates represent similar systems. The chief differences are the nitrate group and minor weight percentages of radionuclides. Hence, the encapsulating waste, as a complex metalo-silicate formed in situ deep within basalt layers will be at essentially equilibrium with its environment, and is quite stable where the system has a stoichiometric excess of metalo-silicate gel, crystallization of complex metalo-silicates will continue for a very long time. Under these conditions no phase changes, dissolution, or exchange of the complex metalo-silicate will take place, providing for an almost ideal mode for radionuclide waste disposal. Storage for a period of 20 half-lives will reduce the respective activities of radionuclides contained in typical Hanford salt cake waste by a factor of over a million.

As is the case for the hereinbefore described hydrothermal process conducted above ground, this underground hydrothermal process provides an inert virtually insoluble crystalline, stone-like solid which may be isolated from man's biosphere for all time.

BENTONITE ADDITION

In still a further embodiment of the invention radionuclides are immobilized in complex metalo-silicates by reacting at atmospheric pressure and an elevated temperature for a period of time bentonite which is a source of alumina and silicon, an alkaline agent such as sodium silicate or caustic soda to raise the pH to at least 10 and the radionuclide waste in the form of an oxide or a hydroxide slurry. This form is preferred as the final complex metalo-silicate is a compound of oxides of the cations of the waste. It has been found that with only limited application of heat, e.g., about 90° to 100°C and pH of at least 10 and atmospheric pressure, radionuclide waste in oxide form, kaolinite and sodium silicate solution are converted into microcrystalline complex aluminosilicates. Steam heating and agitation may be employed to facilitate passing through the induction period.

The duration of the induction period has been found to decrease as the temperature and/or the alkalinity increases. Rapid conversion of the gels to crystals is favored by elevated temperatures and high alkalinity. The temperature in the aqueous alkaline system is limited, however, to about 100°C at atmospheric pressure. A suitable initial solution pH is at least 10.

It is preferred that the radionuclide waste be provided as a fresh slurry of calcined solids and the source of silicon comprise a dilute sodium silicate solution. The reaction product is a fine crystalline precipitate in a solution of silicates. These may be separated by settling, decanting, filtering or centrifuging.

Advantageously, this embodiment affords utilization of radionuclides in the form of oxides as would be available from a typical reprocessing plant and the conversion can be conducted in situ in an underground waste tank. Diatomaceous earth may be substituted for the sodium silicate solution if the mixture of kaolinite and calcined radionuclide waste is sufficiently alkaline when slurryed with water to dissolve these materials and to form complex metalo-silicates. Heat generation by radioactive decay maintains an elevated temperature to aid in passage through the induction period and crystallization. After crystallization the water may be allowed to evaporate.

In summary, the present invention may be seen to involve a process of immobilizing radionuclides in complex metalo-silicates by the formation of a unique ionic, as well as a mechanical, cage within a condensed metalo-silicate lattice which traps the radionuclide and renders it virtually insoluble. This cage formation is produced, in accordance with this invention, in an aqueous system at a pH of at least 10 and a temperature of at least 90°C whereby the metalo-silicate constituents become mobile and reorient themselves around the radionuclide cation as a clatharate, such as for example, in the case of cesium the only radionuclide cation in Group I of the periodic table thereby immobilizing an otherwise very soluble ion. Similar but not identical caging and immobilization occurs with the other radionuclide in Group II through VIII, rendering all silicates and metalo-silicates in these groups virtually insoluble.

Having described the invention in general fashion the following examples are given to indicate with greater particularlity the process parameters and techniques. Example 1 describes the immobilization of cesium in synthetic pollucite by a gel process and is demonstrated with nonradioactive cesium as a substitute for $^{137}Cs$. Example 11 demonstrates an above ground hydrothermal process in which strontium is encapsulated in complex aluminosilicates and is demonstrated with nonradioactive strontium as a substrate for $^{90}Sr$. Example III describes a hydrothermal process of immobilizing a nitrate (salt cake) waste in a deep underground cavern in basalt layers. Example IV describes the immobilization of calcined waste as an oxide slurry by kaolinite and sodium metal silicate addition, while Example V depicts an alternative process for immobilizing $^{137}Cs$ in complex cesium ferrosilicate. Example VI describes an alternative hydrothermal process in basalt caverns by kaolinite and diatomaceous earth additions for immobilizing concentrated complex calcined oxide (PW-4m) waste by sodium metalo-silicate and kaolinite addition followed by slurrying with water and reaction in a storage container. Examples I to VIII demonstrate the criticality of solution pH being of at least 10.

EXAMPLE I

A 1.0 weight percent cesium hydroxide solution was prepared by dissolving 5.0 grams of cesium hydroxide (CsOH) in 500 ml of distilled water. This was converted to an aluminate solution of the same molarity by addition of 2.8 grams of sodium aluminate ($Na_2AlO_2$) to the hydroxide solution. Next, 19.0 grams of sodium metasilicate ($Na_2SiO_3 — 9H_2O$) was added to the solution with mixing. The final molar ratio of cesium hydroxide to sodium aluminate to sodium metasilicate was 1:1:2 the same as the atomic ratio of cesium, aluminum, and silicon in pollucite.

The solution formed a gelatinous precipitate which was transferred with the supernatant liquor to a closed glass container and heated in an oven at 90°C for 13 days. After heating the supernate had a pH of 12.1 and a high sodium concentration. This was decanted and the white microcrystalline precipitate was washed with distilled water, dried at 110°C in an oven and the X-ray diffraction pattern was determined as shown in Table I.

While the solubility of the solid product was not determined due to the extremely fine crystal size, the solubility of natural pollucite was determined for comparison purposes. An accelerated leachability test was used with pure water at approximately 95°C with leaching over a period of about 1 week. The crushed sample of natural pollucite was screened to remove both coarse and very fine material and the remainder was weighed and then continuously exposed to leach water at a constant rate. The accelerated test consists of drying and weighing the sample after each of four conservative 24-hour leach periods. The results are expressed as total grams of solid dissolved per increment of time per unit of surface area of crushed solid. The solubility of the natural pollucite sample as measured by leaching rate with pure water, was $1.2 \times 10^{-7} gm - cm^{-2}/day$.

The solid product was also analyzed by X-ray diffraction. The diffraction pattern for the solid product (Sample) is given in Table I along with Smithsonian natural pollucite and the ASTM std. for analcime ($Na_2O — AL_2O_3 — 4SlO_2$), the sodium analog of pollucite.

TABLE I

| Sample | | | X-ray Diffraction Data Smithsonian Natural Pollucite No. C-2361 | | | ASTM STD. for Analcime | | |
|---|---|---|---|---|---|---|---|---|
| d(A) | I/I | Intensity | d(A) | kkl | Intensity | d(A) | I/I | Intensity |
| 5.57 | 10 | Weak | 5.55 | 211 | Weak | 5.61 | 80 | Strong |
| 3.64 | 42 | Strong | 3.652 | 321 | Strong | 3.67 | 40 | Strong |
| 3.41 | 100 | Very Strong | 3.421 | 400 | Very Strong | 3.43 | 100 | Very Strong |
| — | — | — | 3.048 | 420 | Very Weak | — | — | — |
| 2.91 | 40 | Strong | 2.907 | 332 | Very Strong | 2.925 | 80 | Strong |
| — | — | — | 2.674 | 431 | Weak | — | — | — |
| 2.49 | 11 | Mod. Weak | 2.492 | 521 | Weak | 2.505 | 50 | Strong |
| 2.42 | 27 | Mod. Strong | 2.406 | 440 | Strong | 2.426 | 30 | Mod. Strong |
| 2.21 | 18 | Moderate | 2.211 | 532 | Moderate | 2.226 | 40 | Strong |
| 2.016 | 9 | Weak | 2.007 | 631 | Mod. Weak | 2.022 | 10 | Weak |
| 1.973 | 7 | Weak | 1.970 | 444 | Mod. Weak | 1.94 | 5 | Weak |
| — | — | — | 1.886 | 640 | Weak | 1.903 | 50 | Strong |
| 1.861 | 16 | Mod. Weak | 1.855 | 721 | Strong | 1.867 | 40 | Mod. Strong |
| 1.738 | 16 | Mod. Weak | 1.731 | 651 | Strong | 1.743 | 60 | Strong |
| — | — | — | 1.705 | 800 | Moderate | 1.716 | 30 | Mod. Strong |
| — | — | — | 1.679 | 741 | Weak | — | — | — |
| — | — | — | 1.630 | 653 | Weak | — | — | — |

From a comparison of the X-ray data it may be seen that the product is quite similar to natural pollucite and from the fact that the pollucite pattern rather than the analcime pattern was obtained for the solid product prepared by this gel process establishes that cesium ions are preferentially caged to sodium ions in a mixed system with both ions present. The solubility of the solid product produced by this process will be lower than that determined for natural pollucite, the latter of which contains impurities that are more soluble than the pollucite.

EXAMPLE II

Immobilization of strontium ions in crystalline strontium aluminosilicate by a high pressure, high temperature, hydrothermal process was achieved as follows: For this 5.32 grams of Sr $(OH)_2$ was mixed with 1.4 grams of $Al_2O_3$ and 1.4 grams of $SiO_2$ (silica gel) in 10 ml of water. This gave a stoichiometric mixture equivalent to 2.19 $SrO_2$—1.0 $Al_2O_3$—1.16 $SiO_2$—2.78 $H_2O$.

The resulting aqueous mixture had a pH greater than 10.0 and was placed in a high pressure silver-lined stainless steel autoclave (tested for 3000 psi). The autoclave was closed and placed in an oven. The aqueous mixture was maintained at a temperature of about 300°C (pressure - 1340 psi) for 16 days and then allowed to cool down.

The solid material was then examined and found to be well crystallized, the crystals under a microscope appearing as needle-like laths of about 20 $\mu$ in length.

The product was then analyzed by X-ray diffraction and determined to be orthorhombic crystalline strontium alumino-silicate, a polymorph of strontium feldspar. The X-ray analysis of this product is given in Table II along with published data on the orthorhombic strontium feldspar.

TABLE II

| X-ray Diffraction Data | | | | | |
|---|---|---|---|---|---|
| Sample | | | Orthorhombic Sr Feldspar[a] | | |
| d(A) | I/I | Intensity | d(A) | hkl | Intensity |
| 6.4 | 42 | Moderate | 6.46 | 110 | Mod. Weak |
| 6.1 | 100 | Very Strong | 6.22 | 011 | Moderate |
| — | — | — | 5.12 | 111 | Very Weak |
| — | — | — | 4.17 | 002 | Moderate |
| 3.92 | 75 | Strong | 3.93 | 201 | Very Strong |
| 3.70 | 71 | Strong | 3.71 | 121 | Strong |
| — | — | — | 3.62 | 211 | Weak |
| 3.52 | 88 | Strong | 3.50 | 112 | Strong |
| 3.42 | 79 | Strong | — | — | — |
| 3.25 | 38 | Moderate | — | — | — |
| 3.22 | 100 | Very Strong | 3.22 | 220 | Mod. Strong |
| 3.15 | 50 | Moderate | 3.11 | 022,030 | Mod. Weak |
| 2.90 | 92 | Strong | 2.895 | 212 | Moderate |
| 2.55 | 71 | Strong | 2.553 | 230 | Strong |
| 2.34 | 88 | Strong | 2.338 | 040 | Moderate |
| 2.31 | 38 | Moderate | 2.308 | 123 | Mod. Strong |

[a]Barrer, R. M. et al., "Hydrothermal Chemistry of Silicates. Part XII — Synthetic Strontium Aluminosilicates", J. Chem. Soc. A., p. 495, 1964.

The orthorhombic mode is the more stable mode and where mixtures are first formed the hexagonal mode converts over to the more stable orthorhombic form.

From the similarity of the data, it will be apparent that the product produced by this hydrothermal process is the orthorhombic crystalline strontium aluminosilicate.

EXAMPLE III

Cesium ions may be immobilized in a deep cavern of basalt as complex cesium aluminosilicates. A well is first drilled to a depth of about 4,500 feet into a thick weathered basalt formation and a casing is cemented into the well hole. Four additional wells on a square pattern and centered about the original well are drilled to the same depth for purposes of monitoring.

Strong hydrochloric acid (18°) is pumped into the weathered basalt zone through the central well, dissolving out aluminum, iron and calcium as chlorides. The acid is then neutralized in the process by reaction with the alkaline basalt and the acid leaches out a large cavern.

The acid is followed with a water wash and then caustic (a solution of NaOH) is pumped into the cavern to dissolve the silica that accumulates at the bottom of the cavern after the acid leach. Leaching with caustic dissolves the $SiO_2$ held in the basalt cavern producing a solution of sodium silicate and a pH of 10 or more.

Water is pumped from the four wells at the corners to control the distribution of the sodium silicate solution and to obtain a model of the flow pattern.

After suitable site preparation, a radioactive saltcake waste, such as that stored at the U.S. Atomic Energy Commission's Hanford reservation [composition $NaNO_3$—45%; $Na_2CO_3$—30%; NaOH—10%; other metal salts (Fe, Al, Ca) —5%; water of hydration — 10%; radionuclides 1% (by weight)], including alkaline sludge as a slurry, is pumped into the center well following the path of the caustic and sodium silicate solutions. The Groups II, III, IV, V, VI, VII and VIII metals which have high surface activities precipitate as insoluble colloidal silicates.

All the silicates are precipitated from the hydrothermal system in the cavern in an alkaline pH (i.e., of at least 10) and in the presence of an excess of silica and aluminum. The high concentration of $Na^+$ ions, which stabilize pollucite and other silicates as a result of the common ion effect, afford a highly stable environment.

At the slightly elevated temperature in the cavern and the alkaline environment the silicate gels are converted to microcrystalline solids in a matter of days. As crystals continue to form they grow in size as large crystals are more stable and less soluble than small microcrystals.

The end product is an inert crystalline stone-like solid, insoluble ad isolated from man's biosphere for all time.

EXAMPLE IV

Radionuclide waste containing salt cake or PW-4m calcined waste stored as oxide slurries in tanks near the ground surface may be immobilized as a mixture of simple silicates and complex aluminosilicates as follows. One hundred (100) mols of calcined waste of the oxide slurry are mixed at atmospheric pressure with 100 mols of kaolinite. Then 10 mols of sodium silicate are added to the mixture and the slurry agitated while heating to about 100°C with open steam for 7 days. During this period, the oxides, kaoline and sodium silicate are converted into microcrystalline insoluble silicates and complex aluminosilicate.

The resulting product is a complex mixture of silicates, aluminosilicates and possibly ferrosilicates (if the iron content is significant) which would be an insoluble alkali oxide aluminosilicate.

EXAMPLE V

As an alternative process to immobilizing cesium in aluminosilicates, cesium was immobilized as cesium ferrosilicate, an iron analog of pollucite, by mixing CsOH, sodium silicate ($Na_2SiO_3$—$9H_2O$), and gelatinous ferric hydroxide ($Fe(OH)_3$) with water to provide an aqueous solution having a molar ratio of Cs/silicate/Fe of 1/2/1.

The mixture was then transferred to a closed glass container and placed in an oven at 90°C at atmospheric pressure where it was held for a period of two weeks.

The resulting product was examined and found to be a pinkish brown microcrystalline precipitate. The product was analyzed by X-ray diffraction and the results are given in Table III below along with published X-ray diffraction data for cesium ferrosilicate and synthetic pollucite.

TABLE III

| X-ray Diffraction Data | | | | | | |
|---|---|---|---|---|---|---|
| Sample | | | Cesium Ferrosilicate[b] | | Synthetic Pollucite[b] | |
| d(A) | I | hkl | d(A) | I | d(A) | I |
| 5.54 | — | 211 | — | — | 5.54 | 1 |
| 3.69 | 5 | 321 | 3.690 | 5 | 3.648 | 5 |
| 3.45 | 10 | 400 | 3.453 | 10 | 3.411 | 10 |
| 2.94 | 5 | 332 | 2.942 | 5 | 2.91 | 4 |
| 2.49 | — | 521 | 2.491 | — | 2.491 | 1 |
| 2.44 | 3 | 440 | 2.442 | 3 | 2.412 | 4 |
| 2.231 | 2 | 532 | 2.236 | 2 | 2.216 | 1 |
| 2.036 | 1 | 631 | 2.036 | 1 | 2.013 | 1 |
| 1.879 | 1 | 721 | 1.879 | 1 | 1.857 | 1 |

TABLE III-continued

| X-ray Diffraction Data | | | | | | |
|---|---|---|---|---|---|---|
| Sample | | | Cesium Ferrosilicate[a] | | Synthetic Pollucite[a] | |
| d(A) | I | hkl | d(A) | I | d(A) | I |
| 1.753 | 1 | 651 | 1.753 | 1 | 1.734 | 1 |

[a]Kume S. et al., "Synthetic Pollucites in the System $Cs_2O.AL_2O_3.4S:O_2$-$CS_2O$.-$Fe_2O_3.4SiO_2$-$H_2O$-Their Phase Relationships and Physical Properties, The American Mineralogist, Vol. 50, May, June, 1965.

EXAMPLE VI

Radionuclide waste (PW-4M, a Purex-type commercial processed waste of the Pacific Northwest Laboratory having a spectra of cations, such as Group I (cesium), Group II (yttrium), Group III (zirconium), Group IV (niobium), Group VI (molybdenum), Group VII (technetium), and Group VIII (ruthenium), may be immobilized deep within dense basalt by in situ formation of complex aluminosilicates as follows.

A central or main shaft is first drilled into the basalt layer which is below the water table and a large cavern mined. The shaft is next sealed with hydraulic cement except for feed pipes into the cavern shaft and relief lines from the ends of the cavern to the surface.

The cavern is filled with a dilute solution of sodium silicate from the surface to raise the hydraulic pressure to over 1200 psi. A slurry is prepared above ground from the PW-4M waste, kaolinite, diatomaceous earth and water in the following ratio given in Table IV below.

TABLE IV

| Slurry Formulation | |
|---|---|
| PW-4M Waste (as calcined oxides) | 5 mols |
| Bentonite (on dry basis) | 5 mols |
| Water | 100 mols |

The dry solids are mixed together thoroughly before addition of water to reduce the local generations of heat upon hydration. Cold water (about 30 ml per gram of calcined waste) is added slowly with agitation of the slurry.

The resulting slurry is pumped into the underground cavern soon after mixing the slurry, i.e., within a few hours. As the temperature rises by absorption of radiation energy from the decay of the waste and from chemical reaction between the oxides and the silicates, and the pH increases to at least 10, a colloidal gel is formed as described in Example II. The temperature can rise to about 300°C without formation of a vapor phase because of the hydrostatic pressure at a 3200 foot depth but the relief line at the end of the cavern is provided to permit removal of any vapor actually formed. Additional slurry of lower activity may also be pumped into the cavern to maintain the temperature below 300°C.

After the cavern is filled and hydrothermal crystallization has been in progress for a period of time, such as several weeks, the temperature can be permitted to rise, driving off residual water and leaving a hot dry complex aluminosilicate solid in the cavern.

Owing to the spectra of cations in the waste, the final product is an extremely complex mixture of complex aluminosilicates with minerals such as pollucite and strontium feldspar plus pure silicates such as zircon. Where the pH of the reacting slurry is maintained between 8.0 and 10.0 with a temperature of 300°C, a product having minimum solubility is produced. Zeolite formation is also minimized.

EXAMPLE VII

Concentrated mixed oxides radionuclide waste (PW-4M) may be also immobilized by bentonite addition as follows.

To the waste mixture equal molar ratios of sodium metasilicate and bentonite are added. The resulting mixture is then cooled to a temperature below 100°C and the dry mixture is added slowly to water with cooling continued until a 5 wt% slurry is obtained.

The slurry is next charged into a stainless steel container (about 6 inches in diameter and 8 feet long) with cooling being continued by submersion of the container in cooling water in a water canal. The temperature inside the container should not rise above 100°C without exceeding atmospheric pressure.

The slurry is maintained for about six days and the residual water allowed to escape by permitting a slight rise in temperature (i.e., to the boiling point of approximately 101°C).

The container is then cooled and filled again with a fresh charge of slurry sufficient to fill the container and the process repeated. This is continued until the container is filled with solid product. If desired, the final filling may be with a slurry of a lower melting silicate system such as acmite ($Na_2O$—$FeO$—$SiO_2O$) for final sealing of the container, and filling of remaining voids.

Finally, the cooling water is slowly removed and the remaining water of hydration is driven off by the increase in temperature. The temperature is allowed to rise to 900°C, whereupon the acmite sealant fuses and seals the product into a solid block.

The temperature may then be allowed to rise to an equilibrium temperature, even red heat, without adverse effects; and inasmuch as the complex metalosilicates are non-corrosive and non-volatile, the containers will not be damaged and the radionuclides will not escape. The container may be made permanently sealed by welding and loaded for transportation to a burial site.

EXAMPLE VIII

The influence of pH, temperature and starting materials on the formation of pollucite was further demonstrated by the following. Four tests (1, 2, 3, 5) were made at a temperature of 300°C for a period of two days using different starting materials which resulted in different starting pH values. In tests 1–3, bentonite with CsOH, $Cs_2CO_3$ and CsCl gave starting pHs of 12.5, 10.2 and 6.9 respectively. In test 5 CsCl was used again but with sodium metasilicate and sodium aluminate rather than bentonite and an initial pH of 12.5. The starting materials and water were held at 300°C under pressure in an autoclave for two days. The three tests 1, 2 and 5 that had starting pH values of 10.2 or higher all produced good pollucite. Test 3 with a starting pH of 6.9 produced quartz and bentonite with a reduction if pH to 3.7 but produced no pollucite. Two tests were also made at a lower temperature with starting materials and 500 ml of water held at 90°C for 14 days. Test 4 with bentonite CsCl, 500 ml water and a starting pH of 8.3 produced no pollucite but test 6 with a starting pH of 12.5 produced good pollucite.

TABLE V

Influence of pH, Temperature and Starting Materials on Formation of Pollucite

| Test No. | Starting Materials | Temp. °C | Time Days | Starting pH | Final pH | Products |
|---|---|---|---|---|---|---|
| 1 | Bentonite and CsOH | 300 | 2 | 12.5 | 7.8 | Pollucite |
| 2 | Bentonite and $Cs_2CO_3$ | 300 | 2 | 10.2 | 5.6 | Pollucite |
| 3 | Bentonite and CsCl | 300 | 2 | 6.9 | 3.7 | Bentonite + Quartz |
| 4 | Bentonite and CsCl | 90 | 14 | 8.3 | 8.4 | Bentonite |
| 5 | Sodium metasilicate Sodium aluminate + CsCl | 300 | 2 | 12.5 | 12.5 | Pollucite |
| 6 | Sodium Metasilicate Sodium Aluminate + CsCl | 90 | 14 | 12.5 | 12.5 | Pollucite |

It is to be understood that the foregoing examples are merely illustrative and are not intended to limit the scope of this invention, but the invention should be limited only by the scope of the appended claims.

What is claimed is:

1. A method of immobilizing radionuclides in virtually an insoluble form comprising the steps of drilling a deep main well into a subterranean zone of weathered basalt, forming a sealant casing around the circumference of the entire main well shaft, drilling at least four additional wells into said basalt zone, said additional wells being at a deeper depth than said main well shaft and being in a square pattern around said main well shaft, pumping a strong hydrochloric acid solution into said main well, thereby leaching aluminum, iron and calcium from said basalt and forming a large cavern at the bottom of said main well, injecting a water wash into said main well, adding sufficient caustic to dissolve silica accumulated at bottom of said cavern to thereby form silica gel, and pumping a solution of said radionuclides into said main well, whereby said radionuclides will combine with free aluminum and silicate ions to crystallize out in the form of insoluble complex metalosilicates.

2. The method of claim 1 wherein said redionuclides are selected from the group consisting of $^{137}Cs$, $^{90}Sr$, $^{239}Pu$, $^{241}Am$ and mixtures thereof.

* * * * *